US011173351B2

(12) United States Patent
Molinari

(10) Patent No.: US 11,173,351 B2
(45) Date of Patent: Nov. 16, 2021

(54) SPORTS BALL

(71) Applicant: NIKE, Inc., Beaverton, OR (US)

(72) Inventor: Arthur Parker Molinari, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 16/536,801

(22) Filed: Aug. 9, 2019

(65) Prior Publication Data

US 2020/0070012 A1 Mar. 5, 2020

Related U.S. Application Data

(60) Provisional application No. 62/725,681, filed on Aug. 31, 2018.

(51) Int. Cl.
*A63B 41/08* (2006.01)

(52) U.S. Cl.
CPC ..... *A63B 41/08* (2013.01); *A63B 2243/0025* (2013.01)

(58) Field of Classification Search
CPC . A63B 41/08; A63B 2243/0025; A63B 45/02; A63B 2243/0066; A63B 2243/0037
See application file for complete search history.

(56) References Cited

U.S. PATENT DOCUMENTS 1,931,429 A * 10/1933 Buckner ..... A63B 41/08 473/596
2,182,052 A * 12/1939 Reach ..... A63B 41/08 473/597
2,245,115 A * 6/1941 Reach ..... A63B 41/085 473/597
2,859,040 A 11/1958 Gow
3,512,777 A 5/1970 Henderson
(Continued)

FOREIGN PATENT DOCUMENTS

BE 1016122 A6 3/2006
EP 0885636 A1 12/1998
(Continued)

OTHER PUBLICATIONS

Adrian L. Kiratidis and Derek B. Leinweber, An Aerodynamic Analysis of Recent FIFA World Cup Balls, Special Research Centre for the Subatomic Structure of Matter, Department of Physics, The University of Adelaide, SA, 5005, Australia, Feb. 20, 2018.
(Continued)

*Primary Examiner* — Steven B Wong
(74) *Attorney, Agent, or Firm* — Quinn IP Law

(57) ABSTRACT

A sports ball is provided. The sports ball may include a bladder and a cover disposed about the bladder, wherein the cover includes a plurality of adjoining panels and defines an exterior surface. The cover further defines a plurality of channels extending radially inward from the exterior surface. The plurality of channels includes a plurality of peripheral channel segments and a plurality of interior channel segments. The plurality of peripheral channel segments each define a peripheral seam between adjoining ones of the plurality of panels. Each channel of the plurality of interior channel segments is provided within a central region of one or more of the panels and divide the exterior surface into a plurality of open polygonal portions.

18 Claims, 8 Drawing Sheets

(56) References Cited

U.S. PATENT DOCUMENTS 4,318,544 A * 3/1982 Brine, Jr. ..... A63B 41/08 40/327
4,337,944 A 7/1982 Massino
4,542,902 A 9/1985 Massino
4,736,948 A 4/1988 Thomas
4,928,962 A 5/1990 Finley
4,991,842 A 2/1991 Finley
5,354,053 A * 10/1994 Ratner ..... A63B 41/08 473/596
D357,958 S * 5/1995 Audero, Jr. ..... D21/713
5,427,372 A * 6/1995 Ratner ..... A63B 41/08 156/147
5,451,046 A 9/1995 Batton
5,518,234 A 5/1996 Palmquist
5,683,316 A 11/1997 Campbell
5,735,761 A 4/1998 Palmquist
5,851,161 A 12/1998 Sassak
D408,876 S 4/1999 Feeney
5,931,752 A 8/1999 Guenther et al.
5,984,812 A 11/1999 Sassak
6,012,997 A 1/2000 Mason
6,283,881 B1 * 9/2001 Feeney ..... A63B 41/08 473/596
6,302,815 B1 10/2001 Shishido et al.
6,406,389 B1 6/2002 Feeney et al.
6,422,961 B1 7/2002 Feeney
6,503,162 B1 1/2003 Shishido et al.
6,685,585 B2 2/2004 Shishido et al.
6,988,969 B2 1/2006 Avis
7,300,357 B2 11/2007 Breaker et al.
7,614,959 B1 11/2009 Gentile
7,654,880 B2 2/2010 Schneider
7,854,671 B2 12/2010 Lalvani
8,002,652 B2 8/2011 Wong
8,182,379 B2 5/2012 Rapaport et al.
8,216,098 B2 7/2012 Lalvani
8,262,519 B2 9/2012 Raynak et al.
8,371,971 B2 2/2013 Bevier
8,529,386 B2 9/2013 Nuernberg et al.
8,579,743 B2 11/2013 Cohen et al.
8,597,144 B2 12/2013 Chang et al.
8,608,599 B2 12/2013 Raynak et al.
8,617,011 B2 * 12/2013 Berggren ..... A63B 41/08 473/596
8,672,783 B2 3/2014 Fujikura et al.
8,684,870 B2 4/2014 Ito et al.
8,708,847 B2 4/2014 Berggren et al.
8,777,787 B2 7/2014 Raynak et al.
8,845,466 B2 9/2014 Bevier
8,852,039 B2 10/2014 White et al.
8,926,459 B2 1/2015 Berggren et al.
8,974,330 B2 3/2015 Berggren et al.
9,149,701 B1 10/2015 Bramlette
9,254,424 B2 2/2016 Berggren et al.
9,272,190 B2 3/2016 Tompkins
9,327,167 B2 5/2016 Raynak et al.
9,370,693 B2 6/2016 Berggren et al.
9,370,695 B2 6/2016 Chang et al.
9,452,322 B2 * 9/2016 Thurman ..... A63B 41/08
9,457,239 B2 10/2016 White et al.
9,457,525 B2 10/2016 Berggren et al.
9,468,815 B2 10/2016 Berggren et al.
9,486,675 B1 11/2016 White
9,504,880 B2 11/2016 Bevier
9,539,473 B2 1/2017 Berggren et al.
D786,374 S * 5/2017 Deaton ..... D21/713
D786,375 S * 5/2017 Deaton ..... D21/713
9,694,247 B2 7/2017 Nurnberg
9,814,941 B2 11/2017 Cohen et al.
9,821,195 B2 11/2017 Raynak et al.
9,855,469 B2 1/2018 Berggren et al.
9,884,227 B2 2/2018 Berggren et al.
9,919,483 B2 3/2018 Nurnberg
10,016,935 B2 7/2018 Berggren et al.
D863,473 S * 10/2019 Smith ..... D21/713
D863,474 S * 10/2019 Smith ..... D21/713
2004/0142780 A1 7/2004 Estefano
2006/0105866 A1 5/2006 Ma
2006/0205544 A1 9/2006 Wyner et al.
2006/0229150 A1 10/2006 Ou
2007/0117662 A1 5/2007 Ma
2008/0032834 A1 2/2008 Krysiak
2008/0287218 A1 11/2008 Freund
2009/0042659 A1 2/2009 Breaker et al.
2009/0325742 A1 * 12/2009 Krysiak ..... A63B 41/08 473/596
2010/0255940 A1 * 10/2010 Nuernberg ..... A63B 41/08 473/604
2011/0012309 A1 1/2011 Schreff
2011/0152018 A1 6/2011 Walling et al.
2011/0250819 A1 10/2011 Tashman
2011/0250997 A1 10/2011 Walling et al.
2012/0172160 A1 7/2012 Marc
2013/0005520 A1 1/2013 Chang et al.
2013/0059683 A1 3/2013 Krysiak et al.
2013/0260927 A1 10/2013 Thurman et al.
2014/0038741 A1 2/2014 Brooks
2014/0179468 A1 6/2014 Berggren et al.
2014/0179469 A1 * 6/2014 Berggren ..... A63B 41/08 473/604
2015/0367183 A1 12/2015 Ou
2016/0082323 A1 3/2016 Higa et al.
2016/0089580 A1 3/2016 Nurnberg
2016/0243408 A1 8/2016 Tompkins
2016/0263444 A1 9/2016 Nurnberg
2016/0288438 A1 10/2016 Chang et al.
2016/0346627 A1 12/2016 Le et al.
2016/0346964 A1 12/2016 Nurnberg et al.
2017/0050089 A1 2/2017 Velasco
2017/0246512 A1 8/2017 Berggren et al.
2017/0291076 A1 10/2017 Campbell
2017/0354851 A1 12/2017 Lyon
2018/0078827 A1 3/2018 Berggren et al.
2018/0111024 A1 4/2018 Ou
2018/0133562 A1 * 5/2018 Berggren ..... A63B 41/08
2018/0154220 A1 6/2018 Campbell
2018/0161636 A1 6/2018 Ahmed
2018/0169483 A1 6/2018 Ou
2018/0200969 A1 7/2018 Nurnberg
2018/0243614 A1 * 8/2018 Berggren ..... A63B 43/008
2018/0243615 A1 8/2018 Berggren et al.
2018/0339202 A1 11/2018 Molinari
2019/0184242 A1 6/2019 Molinari
2020/0070011 A1 * 3/2020 Molinari ..... A63B 41/08
2020/0070012 A1 * 3/2020 Molinari ..... A63B 45/02
2020/0171359 A1 6/2020 Molinari
2020/0230468 A1 7/2020 Molinari et al.

FOREIGN PATENT DOCUMENTS

GB 2375054 A * 11/2002 ..... A63B 41/08
GB 2375054 A 11/2002
GB 2447845 A 10/2008
WO 2005115561 A1 12/2005

OTHER PUBLICATIONS

F. Alam, H. Chowdhury, B. Loganathan, I. Mustary and S. Watkins, Aerodynamic Drag of Contemporary Soccer Balls, 19th Australasian Fluid Mechanics Conference, Melbourne, Australia, Dec. 2014.

Firoz Alam, Harun Chowdhury, Mark Stemmer, Zilong Wang and Jie Yang, Effects of surface structure on soccer ball aerodynamics, Procedia Engineering 34 (2012) pp. 146-151, Published by Elsevier Ltd.

John Eric Goff, Matt J. Carre, Investigations into soccer aerodynamics via trajectory analysis and dust experiments, Procedia Engineering 34 (2012) pp. 158-163, Published by Elsevier Ltd.

John Eric Goff, Sungchan Hong and Takeshi Asai, Aerodynamic and surface comparisons between Telstar 18 and Brazuca, Journal of

(56) References Cited

OTHER PUBLICATIONS

Sports Engineering and Technology, 2018, pp. 1-7, DOI: 10.1177/1754337118773214.
Luca Oggiano, Lars Saetran, Aerodynamics of modern soccer balls, Procedia Engineering 2 (2010) pp. 2473-2479, Published by Elsevier Ltd.
Pouya Jalilian, Patrick K. Kreun, Mohammadhady M. Makhmalbaf and William W. Liou, Computational Aerodynamics of Baseball, Soccer Ball and Volleyball, American Journal of Sports Science, vol. 2, No. 5, 2014, pp. 115-121, doi: 10.11648/j.ajss.20140205.12.
Sungchan Hong and Takeshi Asai, Aerodynamic effects of dimples on soccer ball surfaces, Heliyon 3 (2017) e00432, doi: 10.1016/j.heliyon.2017.e00432.
Sungchan Hong and Takeshi Asai, Effect of panel shape of soccer ball on its flight characteristics, Sci. Rep. 4, 5068; DOI:10.1038/srep05068 (2014).
T. Asai, K. Seo, O. Kobayashi and R. Sakashita, Fundamental aerodynamics of the soccer ball, Sports Engineering (2007) 10, pp. 101-110.
Takeshi Asai, Kazuya Seo, Aerodynamic drag of modern soccer balls, SpringerPlus 2013, 2:171, Published Apr. 19, 2013.

* cited by examiner

SPORTS BALL

CROSS-REFERENCE TO RELATED APPLICATIONS

This application claims the benefit of U.S. Provisional Application No. 62/725,681, filed Aug. 31, 2018, which is hereby incorporated by reference in its entirety.

TECHNICAL FIELD

The disclosure relates to inflatable sports balls.

BACKGROUND

A variety of inflatable sport balls, such as soccer balls, conventionally exhibit a layered structure that includes a casing, an intermediate structure, and a bladder. The casing forms an exterior portion of the sports ball and is generally formed from a plurality of durable and wear-resistant panels joined together along abutting edge areas (e.g., with stitching, adhesives, or bonding), i.e., via a seam. Designs such as decorative elements and holistic textural patterns may be applied to the exterior surface of the casing. Decorative elements are conventionally applied via processes such as thermal transfer films or a release paper. Textural patterns are conventionally applied via processes such as embossing, debossing, stamping, molding, or laser etching.

The intermediate structure forms a middle portion of the sport ball and is positioned between the casing and the interior. Among other purposes, the intermediate structure may provide a softened feel to the sport ball, impart energy return, and restrict expansion of the bladder. In some configurations, the intermediate structure or portions of the intermediate structure may be bonded, joined, or otherwise incorporated into the casing as a backing material. In other configurations, the intermediate structure or portions of the intermediate structure may be bonded, joined, or otherwise incorporated into the interior.

SUMMARY

A sports ball is provided. The sports ball may include an interior bladder and a cover disposed about the interior bladder. The cover may include a plurality of adjoining panels. The cover may define an exterior surface comprising a plurality of plateau sections and a plurality of channels extending radially inward from the exterior surface.

The plurality of channels may include a plurality of peripheral channel segments and a plurality of interior channel segments. The plurality of peripheral channel segments may each define a peripheral seam between adjoining panels. The plurality of interior channel segments may each be provided within a central region of one or more of the panels, such that the interior channel segments divide the exterior surface into a plurality of open polygonal portions.

Each interior channel segment defines a side of at least one of the open polygonal portions and the plateau sections define the interior of each open polygonal portion between the interior channel segments. Accordingly, the peripheral channel segments, the interior channel segments, and the plateau sections cooperate to define a topographical arrangement across the exterior surface of the cover.

DETAILED DESCRIPTION

Figure 1:
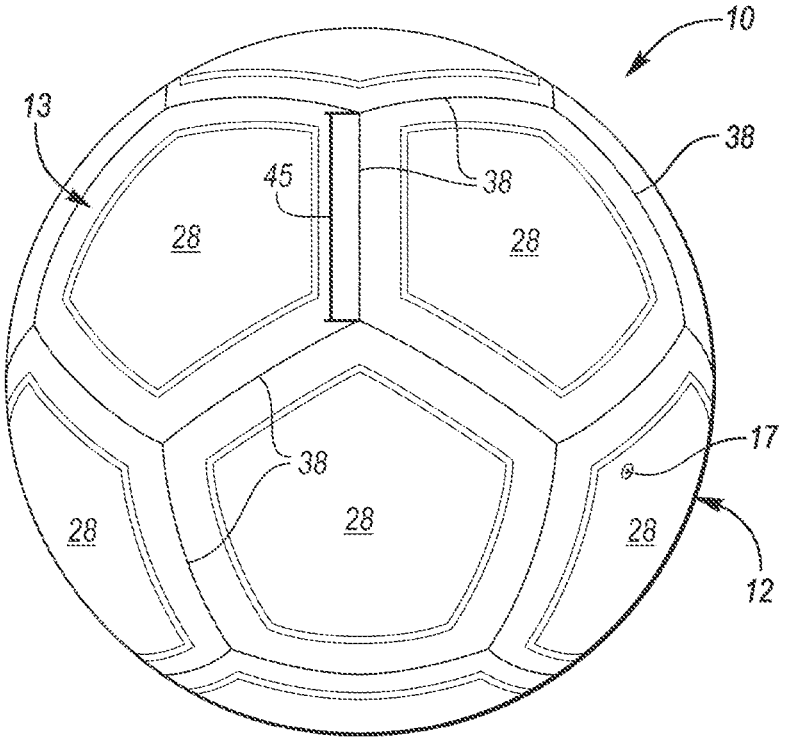
FIG. 1 is a schematic perspective view of an example inflatable sports ball.

While the present disclosure may be described with respect to specific applications or industries, those skilled in the art will recognize the broader applicability of the disclosure. Those having ordinary skill in the art will recognize that terms such as "above," "below," "upward," "downward," etc., are used descriptively of the figures, and do not represent limitations on the scope of the disclosure, as defined by the appended claims. Any numerical designations, such as "first" or "second" are illustrative only and are not intended to limit the scope of the disclosure in any way.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or"

includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

The terms "a," "an," "the," "at least one," and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

Features shown in one figure may be combined with, substituted for, or modified by, features shown in any of the figures. Unless stated otherwise, no features, elements, or limitations are mutually exclusive of any other features, elements, or limitations. Furthermore, no features, elements, or limitations are absolutely required for operation. Any specific configurations shown in the figures are illustrative only and the specific configurations shown are not limiting of the claims or the description.

The following discussion and accompanying figures disclose various sports ball configurations and methods relating to manufacturing of the sport balls. Although the sports ball is depicted as a soccer ball in the associated Figures, concepts associated with the configurations and methods may be applied to various types of inflatable sport balls, such as basketballs, footballs (for either American football or rugby), volleyballs, water polo balls, etc. and variety of non-inflatable sports balls, such as baseballs and softballs, may also incorporate concepts discussed herein.

Referring to the drawings, wherein like reference numerals refer to like components throughout the several views, a sports ball 10 is provided. In a general sense, the sports ball 10 of the present disclosure includes a plurality of outer panels 28 having a topographical arrangement 56 disposed thereon, such that the topographical arrangement 56 is defined by a plurality of peripheral channel segments 38 and a plurality of interior channel segments 34. The plurality of interior channel segments 34 may each be provided within a central region of one or more of the panels 28, such that the interior channel segments 34 divide the exterior surface 13 of the panels 28 into a plurality of open polygonal portions 54. Such a configuration has been found to provide aerodynamic consistency and softness and feel characteristics that are improved from conventional designs.

Figure 2:
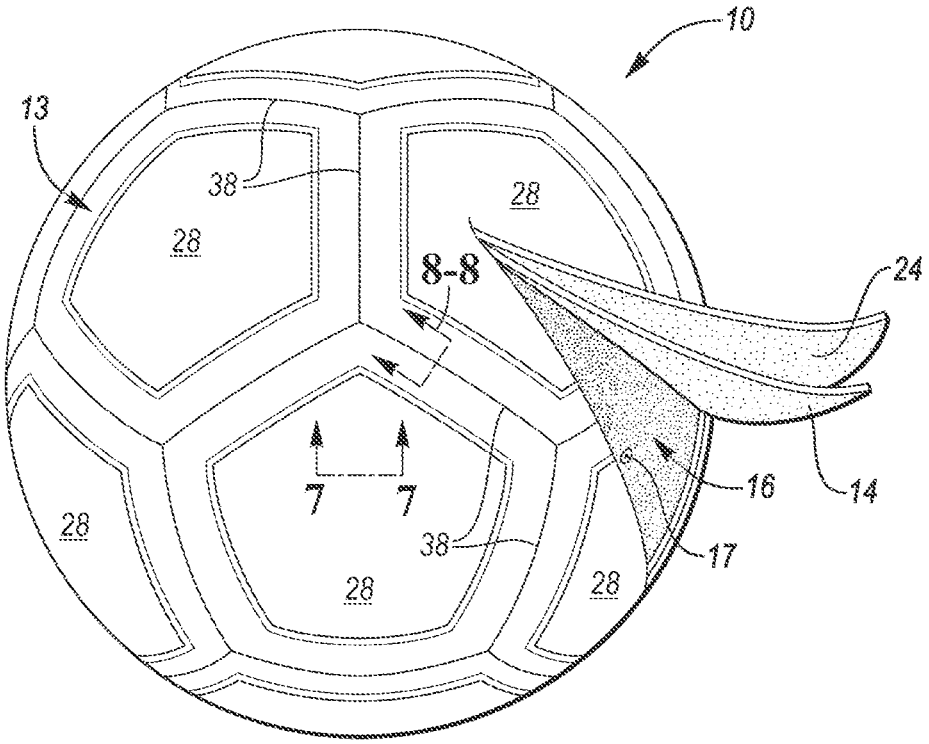
FIG. 2 is a schematic perspective view of an example inflatable sports ball, wherein the ball includes an interior bladder and a cover, the cover including an outer substrate layer and an intermediate structure.
Figure 7:
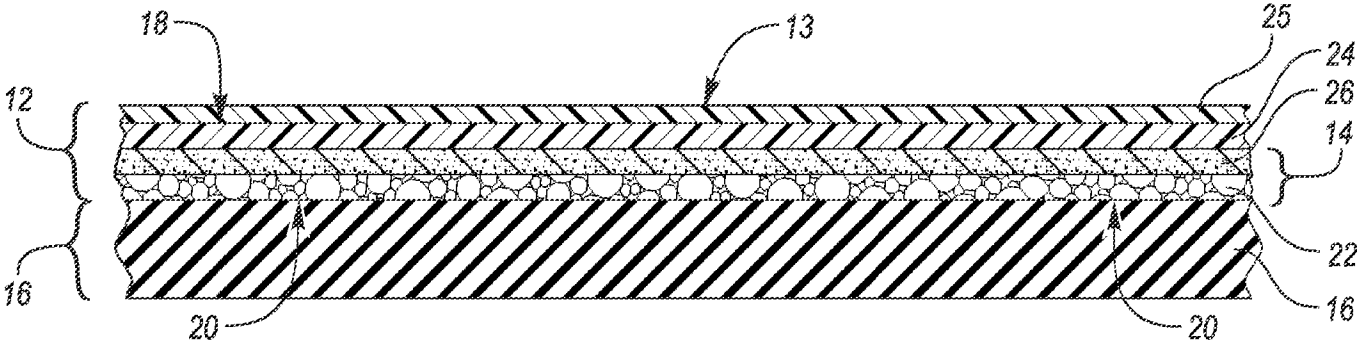
FIG. 7 is an example cross-section view of the cover taken along line 7-7 in FIG. 2.
Figure 8:
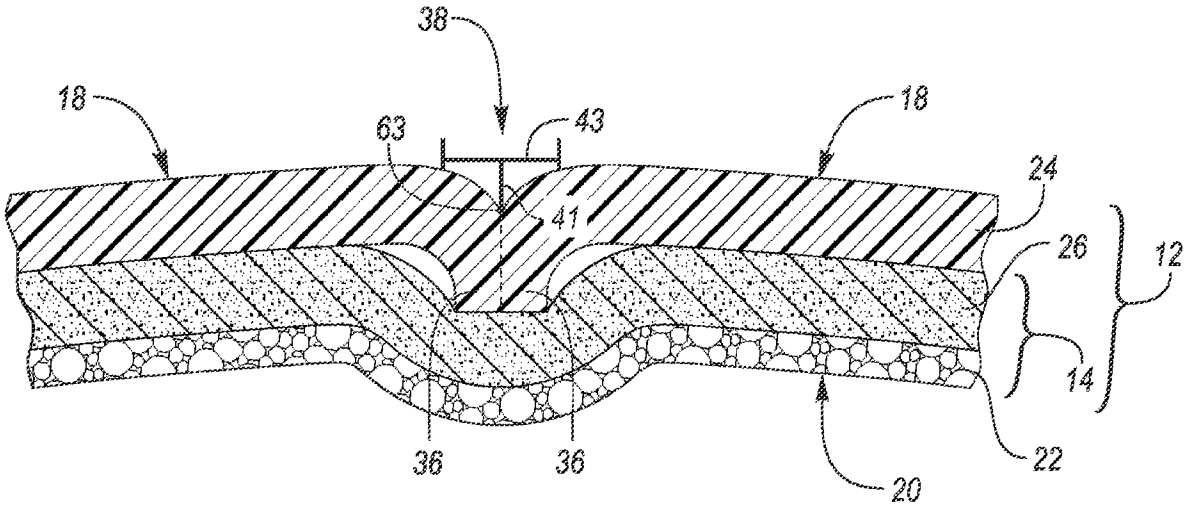
FIG. 8 is an enlarged, schematic, example cross-section of a peripheral channel segment taken along line 8-8 in FIG. 2.

As shown in FIGS. 1-3 and 5, the sports ball 10 may be an inflatable sports ball such as a soccer ball or the like or a non-inflatable sports ball 10 such as a softball or the like. A sports ball 10 having the general configuration of a soccer ball is depicted in FIGS. 1-3 and 5. As shown in FIGS. 1 and 2, the sports ball 10 may have a layered structure including a cover 12 and an interior 16 (FIGS. 2 and 7-8). The cover 12 forms an exterior portion of the sports ball 10. The interior 16 forms an interior portion of sports ball 10.

In a non-inflatable example configuration of the sports ball 10, the interior 16 may be one of a solid mass and hollow mass, fixed in size. In an inflatable example configuration of the sports ball 10, the interior 16 may be an interior bladder (FIGS. 2 and 7-8). In the inflatable example configuration, in order to facilitate inflation (i.e., fill the interior with pressurized air), the interior 16 generally includes a valved opening 17 that extends through the cover 12, thereby being accessible from an exterior surface 13 of the sports ball 10. Upon inflation, the bladder 16 is pressurized and the pressurization induces the outer substrate surface 18 to be a substantially spherical surface as the sports ball 10 takes on a substantially spherical shape. More particularly, pressure within bladder 16 causes the bladder 16 to place an outward force upon the cover 12 on an inner substrate surface 20.

The cover 12 forms an exterior portion of the sports ball 10 and defines an exterior surface 13. The term cover 12 is meant to include any layer of the sports ball 10 that surrounds the interior 16. Thus, the cover 12 has a thickness 88 and may include both the outermost layer and also any intermediate layers, which are disposed between the interior 16 and the exterior surface 13. As shown in FIGS. 2 and 7-8, the cover 12 may be composed as a layered structure including an outer substrate layer 24 and an intermediate structure 14 located interior to the outer substrate layer 24 between the outer substrate layer 24 and the interior 16. The outer substrate layer 24 further defines an outer substrate surface 18. The inner substrate surface 20 is disposed opposite the outer substrate surface 18, and may be disposed adjacent to the ball interior 16.

In some embodiments, the outer substrate layer 24 may be composed of a polymeric material, a polymer foam material, or the like. Examples of suitable polymer materials include, but are not limited to, polyurethane, polyvinylchloride, polyamide, polyester, polypropylene, polyolefin, and the like.

The intermediate structure 14 may include a first intermediate cover layer 26 and a second intermediate cover layer 22. The first intermediate cover layer 26 is positioned between the outer substrate 24 and the second intermediate cover layer 22. The second intermediate cover layer 22 is positioned between the first intermediate cover layer 26 and the interior bladder 16. The second intermediate cover layer 22 may include the inner substrate surface 20, wherein the inner substrate surface 20 is positioned adjacent to the ball interior 16.

The respective cover layers 22, 26 of the intermediate structure 14 may be composed of a polymeric material, a polymer foam material, a foam material, textiles, or the like. Examples of suitable polymer materials include, but are not limited to, polyurethane, polyvinylchloride, polyamide, polyester, polypropylene, polyolefin, and the like. Examples of suitable polymer foam materials include, but are not limited to, polyurethane, ethylvinylacetate, and the like. Examples of suitable textile materials include, but are not limited to, a woven or knit textile formed from polyester, cotton, nylon, rayon, silk, spandex, or a variety of other materials. A textile material may also include multiple materials, such as a polyester and cotton blend. The intermediate structure 14 may further provide a softened feel to the sports ball, impart energy return, and restrict expansion of bladder 16, in an inflatable sports ball 10 example. In one example, the outer substrate layer 24 may be formed a thermoplastic polyurethane material (TPU), first intermediate layer 26 may be formed from a polymer foam material, the second intermediate layer 22 may be formed from a textile material.

As shown in FIG. 7, the cover may further include an external surface layer 25 disposed upon the outer substrate surface 18 of the cover 12. The external surface layer 25 may be a film that includes a pigment or a graphic thereon. The external surface layer 25 may also be an outer film or clear coat having weather resistant properties. The external surface layer 25 may be a polyurethane film or the like. The external surface layer 25 may be bonded to the outer substrate surface 18 via a bonding material.

As shown in FIGS. 1-6, the cover 12 may be generally formed by a plurality of adjoining panels 28. Each panel 28 may have a respective panel surface that defines a portion of the outer substrate surface 18. The plurality of adjoining panels 28 includes at least a first panel 30 having a first panel surface and a second panel 40 having a second panel surface. The plurality of adjoining panels 28 may comprise the conventional twelve (12) panels or any other number of panels 28. For example, four joined panels 28 each having nine edges 36 and having a generally triangular shape that is formed from three pentagons. The cover 12 may also exhibit a substantially uniform or unbroken configuration that does not include panels 28 joined at abutting edge areas 36 via seams 38, or may include fewer panels 28.

As shown in FIGS. 3-8, and 9A-9G, the cover 12 may further define a plurality of channels 34, 38. Each of the channels of the plurality of channels 34, 38 may extend radially inward from the exterior surface 13. The exterior surface 13 of the cover 12 may further define a plurality of plateau sections 35 disposed between the channels 34, 38. The plurality of channels 34, 38 may be further defined as a plurality of peripheral channel segments 38 and plurality of interior channel segments 34.

In one example, the plurality of peripheral channel segments 38 may be defined as a plurality of seams 38 configured to couple the plurality of panels 28 and define a peripheral seam 38 between the plurality of adjoining panels 28. The respective panels 28 may be coupled together along abutting edge areas 36 (FIGS. 4 and 6) via at least one peripheral channel segments or seam 38 (FIGS. 1-6 and 8).

The panels 28 may be coupled along the abutting edge areas 36 by the seam 38 with stitching, bonding, welding, adhesives, or another suitable coupling method. As utilized herein, the term "welding" or variants thereof (such as "thermal bonding") is defined as a technique for securing two elements to one another that involves a softening or melting of a polymer material within at least one of the elements such that the materials of the elements are secured to each other when cooled. Similarly, the term "weld" or variants thereof (e.g., "thermal bond") is defined as the bond, link, or structure that joins two elements through a process that involves a softening or melting of a polymer material within at least one of the elements such that the materials of the elements are secured to each other when cooled. An example of welded seams 38 is disclosed in U.S. Pat. No. 8,608,599 to Raynak, et al., which is hereby entirely incorporated herein by reference. U.S. Pat. No. 8,608,599 to Raynak, et al. generally discloses examples of welded seams, in that welding generally produces a heat affected zone in which the materials of the two joined components are intermingled. This heat affected zone may be considered a "weld" or "thermal bond." Further, welding may involve (a) the melting or softening of two panels that include polymer materials such that the polymer materials from each panel intermingle with each other (e.g., diffuse across a boundary layer between the polymer materials) and are secured together when cooled, as well as (b) the melting or softening of a polymer material in a first panel such that the polymer material extends into or infiltrates the structure of a second panel (e.g., infiltrates crevices or cavities formed in the second panel or extends around or bonds with filaments or fibers in the second panel) to secure the panels together when cooled. Further, welding may occur when only one panel includes a polymer material or when both panels include polymer materials.

Referring to FIG. 8, each seam 38 has a seam terminus 63 that is radially-spaced apart from and radially extending inward from the exterior surface 13 toward the inner substrate surface 20. Further, each seam 38 has a seam depth 41 and a seam width 43. The seam terminus 63 is radially-spaced apart from the outer substrate surface 18 the seam depth 41. In one example, as shown in FIGS. 3-6, the seam depth 41 may be greater than 0.40 millimeters. More particularly, the seam depth 41 may be about 0.40 millimeters to 1.0 millimeters. The seam width 43 may be from about 0.40 centimeters to 1.0 centimeters.

Further, each seam or peripheral channel segment 38 may have a seam length 45. The plurality of seams 38 may further define a first aggregate deboss length. The first aggregate deboss length is defined as a sum of all of the seam lengths 45. In some example embodiments, the first aggregate deboss length may be from about 135 centimeters to about 150 centimeters. As shown in the examples in FIGS. 3-6, the first aggregate deboss length may be about from about 140 centimeters to about 145 centimeters.

Referring to FIGS. 3-6 and 9A-9G, the plurality of interior channel segments 34 may be formed as a plurality of pseudo seams or debossed features. The term pseudo seam and/or debossed feature as used herein is defined as an indentation in the cover 12 that is not a seam 38. Debossed features 34 may impart various advantages to the ball 10. For example, debossed features 34 may enhance the aerodynamics of the ball 10 or provide a greater amount of consistency or control over ball 10 during play, e.g., during kicking, dribbling, or passing.

In some example embodiments, interior channel segments 34 may be spaced apart from the seams 38 of the sport ball 10. In other example embodiments, interior channel segments 34 may extend to edges 36 of the panels 28 and, thus, continue across a respective seam 38. More particularly, an interior channel segment 34 on a first panel 30 and an interior channel segment 34 on a second panel 40 may be in substantial alignment with one another across a respective seam 38. This may also enable patterns, arrangements, or other designs to be carried across multiple panels, bridging seams 38 between the panels 28. In an example embodiment, wherein the cover 12 has a substantially uniform or unbroken configuration that does not include panels 28 or includes fewer panels, a debossed feature or interior channel segment 34 may be positioned in areas of the cover 12 that correspond with the positions of seams 38 in a conventional twelve panel sports ball 10, in order to impart the appearance of seams 38.

As shown in FIG. 9A-9G, each interior channel segment 34 has an interior channel segment terminus 65 that is radially-spaced apart from and extends radially inward from the exterior surface 13 toward the inner substrate surface 20. Further, each interior channel segment 34 has an interior channel segment depth 67 and an interior channel segment width 61. The interior channel segment terminus 65 is radially-spaced apart from the exterior surface 13 by the interior channel segment depth 67. In one example, as shown in FIGS. 3-6, the channel depth 67 may be greater than 0.4 millimeters. More particularly, the channel depth 67 may be from about 0.8 millimeters to about 1.2 millimeters. In one example, as shown in FIGS. 3-6, the channel width 61 may be from about 7.0 millimeters to about 12.0 millimeters.

The plurality of interior channel segments 34 may be formed on the cover via a variety of manufacturing processes including, but not limited to, debossing. Examples of a manufacturing process for forming debossed features 34 are disclosed in U.S. Pat. No. 9,370,693 to Berggren, et al., which is hereby entirely incorporated by reference herein. U.S. Pat. No. 9,370,693 to Berggren, et al. generally discloses a variety of manufacturing processes that may be utilized to form debossed features 34 in panels 28. In one example, one of panels is located on a platen. A press plate is positioned above the platen and includes a protrusion having a predetermined shape. The protrusion presses into and heats the areas of panel forming the debossed features. The press plate then moves away from the panel to substantially complete the formation of the debossed feature.

Referring to FIGS. 9A-9G, the interior channel segments 34 are formed in the cover 12 and extend radially inward from the exterior surface 13 toward the interior 16. The intermediate structure 14 is positioned between the outer substrate layer 24 and the interior bladder 16. The outer substrate layer 24 may be bonded to the intermediate structure 14 at the respective interior channel segment 34. More particularly, the outer substrate layer 24 may be welded directly to the second intermediate cover layer 22 at the interior channel segment terminus 65 of the respective interior channel segment 34 (FIGS. 9A-C and 9E-G), such that the outer substrate layer 24 extends through an entirety of the channel depth 67 at each of the interior channel segments 34.

The interior channel segments 34 may include a first portion 82 and a second portion 84. The first portion 82 has the interior channel segment terminus 65 thereon that is radially-spaced apart from the exterior surface 13 by the channel depth 67. Further, each plateau section 35 is defined between interior channel segments 34, such that each interior channel segment 34 abuts the adjacent plateau section 35 at a connection edge positioned at a shoulder portion 29 of the respective interior channel segment 34. Each interior channel segment 34 may be linear along the connection edge, such that the connection edge itself is linear.

Figure 9A:
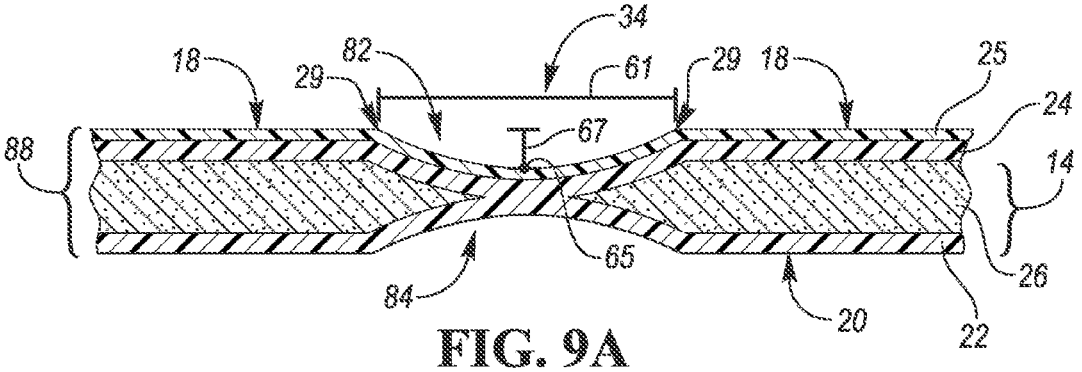
FIG. 9A is an enlarged, schematic, example cross-section of an example interior channel segment.
Figure 9B:
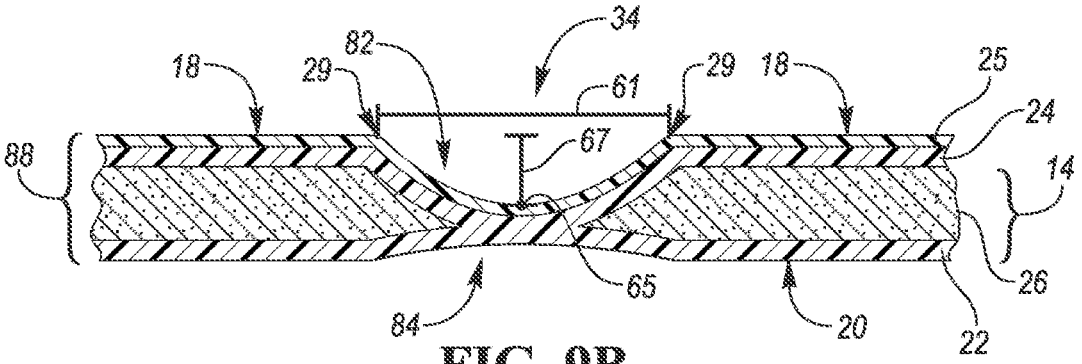
FIG. 9B is an enlarged, schematic, example cross-section of an example interior channel segment.
Figure 9C:
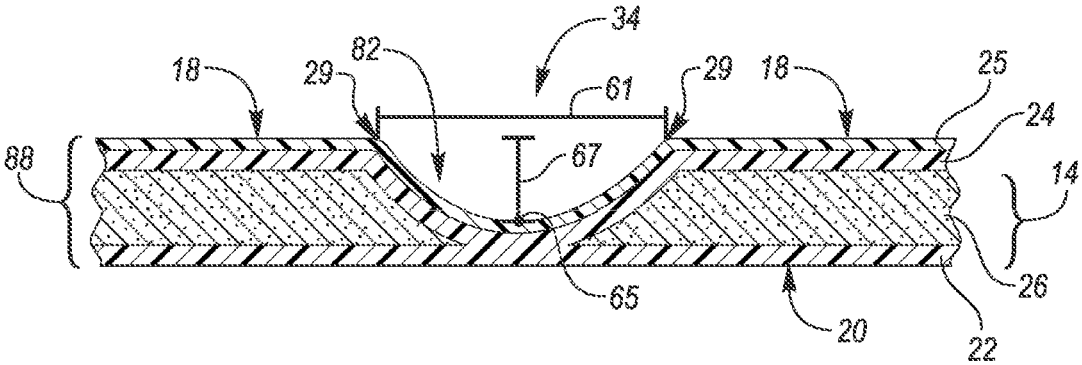
FIG. 9C is an enlarged, schematic, example cross-section of an example interior channel segment.

The specific configuration of the interior channel segments 34 may vary considerably. Referring to FIG. 9A-9D, the first and second portions 82 and 84 may have a generally rounded configuration. As depicted in FIG. 9A the first and second portions 82 and 84 extend to an approximate midpoint of the thickness 88 of the panel cross-section. In another configuration, as depicted in FIGS. 9B and 9C, the first portion 82 extends through more of the thickness 88 of panel cross section than the second portion 84. In yet another configuration, as depicted in FIG. 9C, the first portion 82 extends through substantially all of the thickness 88 of panel cross-section. As also shown in FIG. 9C, in some embodiments, the second intermediate layer 22 may have a substantially planar configuration opposite the first portion 82. Said another way, in some embodiments, the interior channel segment 34 may have only a first portion 82 and no second portion 84.

Figure 9D:
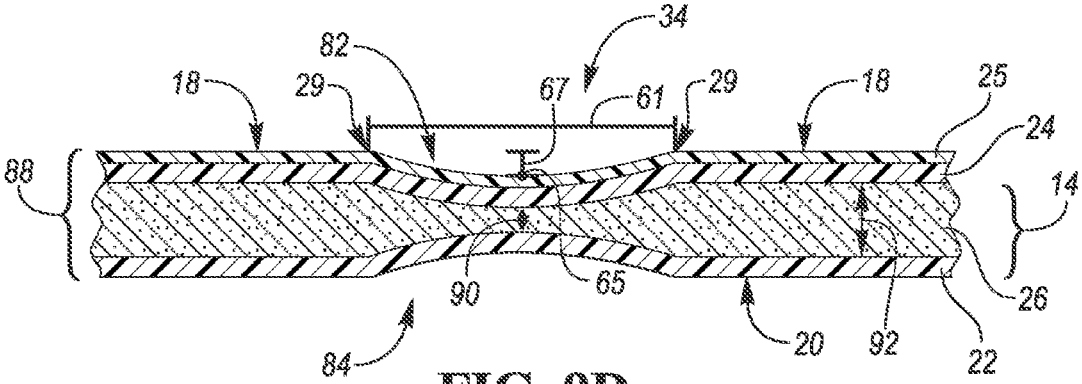
FIG. 9D is an enlarged, schematic, example cross-section of an example interior channel segment.

Referring to FIG. 9D, portions 82 and 84, as well as the outer substrate layer 24 and the second intermediate cover layer 22, may be spaced from each other, such that a portion of the first intermediate layer 26 extends between portions 82 and 84 and between the outer substrate layer 24 and the second intermediate cover layer 22. In this configuration, the outer substrate 24 is bonded to the first intermediate layer 26 at the interior channel 34. In such an example, the first intermediate layer 26 has a first thickness 90 between portions 82 and 84 and at the interior channel segment terminus 65 of the first portion 82. In the same example, the first intermediate layer 26 has a second thickness 92 between the outer substrate layer 24 and the second intermediate cover layer 22, in an area spaced apart from portions 82 and 84 and the interior channel segment terminus 65 of the first portion 82. As shown in FIG. 9D, the first thickness 90 is less than the second thickness 92.

Figure 9E:
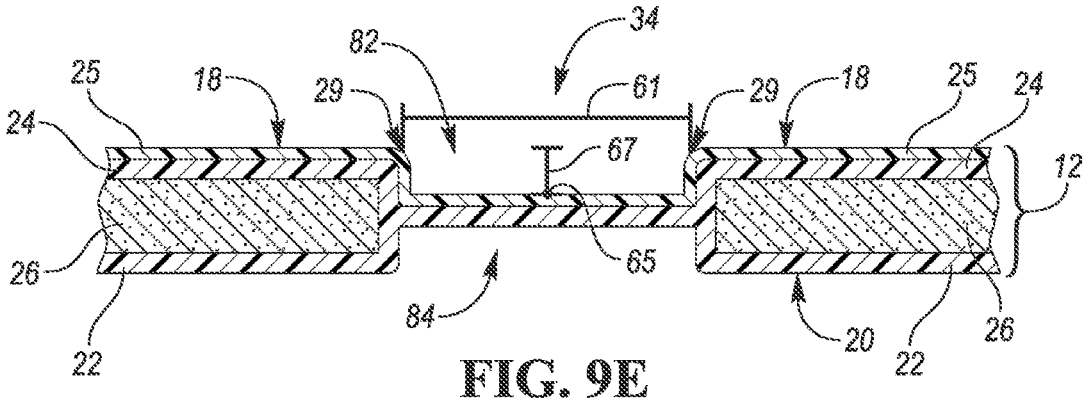
FIG. 9E is an enlarged, schematic, example cross-section of an example interior channel segment.
Figure 9F:
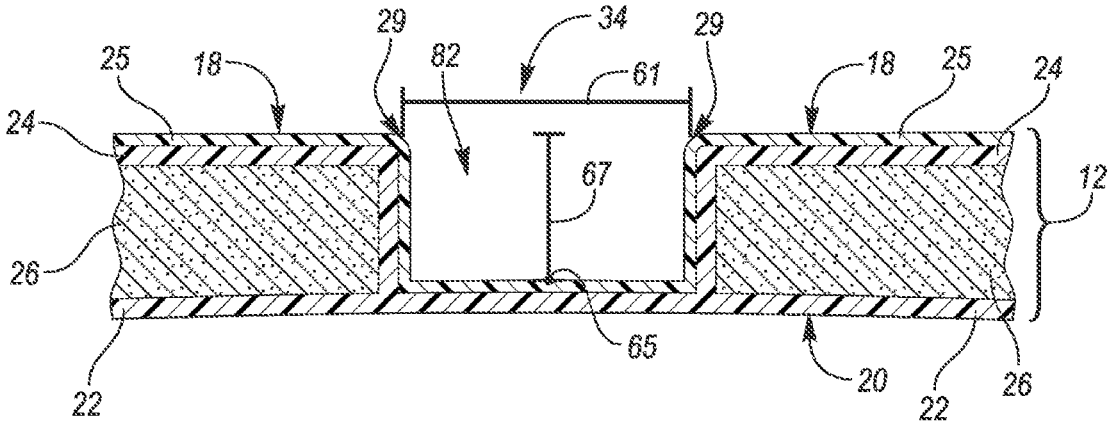
FIG. 9F is an enlarged, schematic, example cross-section of an example interior channel segment.
Figure 9G:
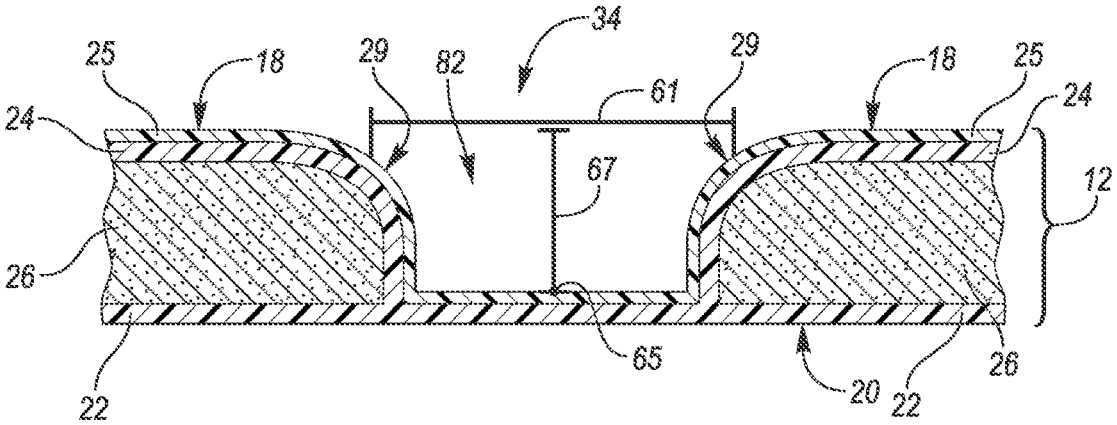
FIG. 9G is an enlarged, schematic, example cross-section of an example interior channel segment.

Alternatively, the interior channels 34 may include a first portion 82 and a second portion 84 that exhibit substantially squared configurations (FIGS. 9E-9G). For example, in some embodiments, the portions 82, 84 may have substantially squared cross-sectional configurations. Such substantially squared cross-sectional configurations may have a more distinct appearance than indentations having substantially rounded cross-sectional configurations. In addition, substantially squared indentations may also provide performance benefits such as aerodynamics, ball feel, and water channeling.

As shown in FIG. 9E, the first portion 82 and second portion 84 are two opposing indentations having substantially squared cross-sectional configurations. In FIG. 9E, the portions 82 and 84 extend to an approximate midpoint of the thickness 88 of the panel cross-section, such that the interior channel segment terminus 65 of the first portion 82 is positioned radially inward from the exterior surface 13 to the approximate midpoint of the thickness 88 of the panel cross-section.

In FIGS. 9F-9G, the first portion 82 may extend through substantially the entirety of the thickness 88 of the panel cross section. As also shown in FIG. 9F-9G, in some embodiments, second intermediate layer 22 may have a substantially planar configuration opposite the first portion 82. Said another way, in some embodiments, the debossed feature 34 may have only a first portion 82 and no second portion 84.

As shown in FIG. 9G, in one example embodiment, the interior channel 34 may include substantially-squared first portion 82 having a rounded shoulder portion 29. In some embodiments, a substantially-squared shoulder portion 29 may have a minimal radius, as shown in FIG. 9F. In another example embodiment, a rounded shoulder portion 29 having a larger radius may be used, as shown in FIG. 9G.

Further, each interior channel segment 34 may have an interior channel segment length 50. In one example, the interior channel segment length 50 of each interior channel segment 34 may be from about 1.0 centimeters to about 2.0 centimeters.

The plurality of interior channel segments 34 may further define a second aggregate deboss length. The second aggregate deboss length is defined as a sum of all of the interior channel segments lengths 50. In some example embodiments, the second aggregate deboss length may be greater than 600 centimeters. More particularly, the second aggregate deboss length may be from about 620 centimeters to about 650 centimeters. More particularly, the second aggregate deboss length shown in the examples of FIGS. 3-6 may be about 630 centimeters.

Figure 3:
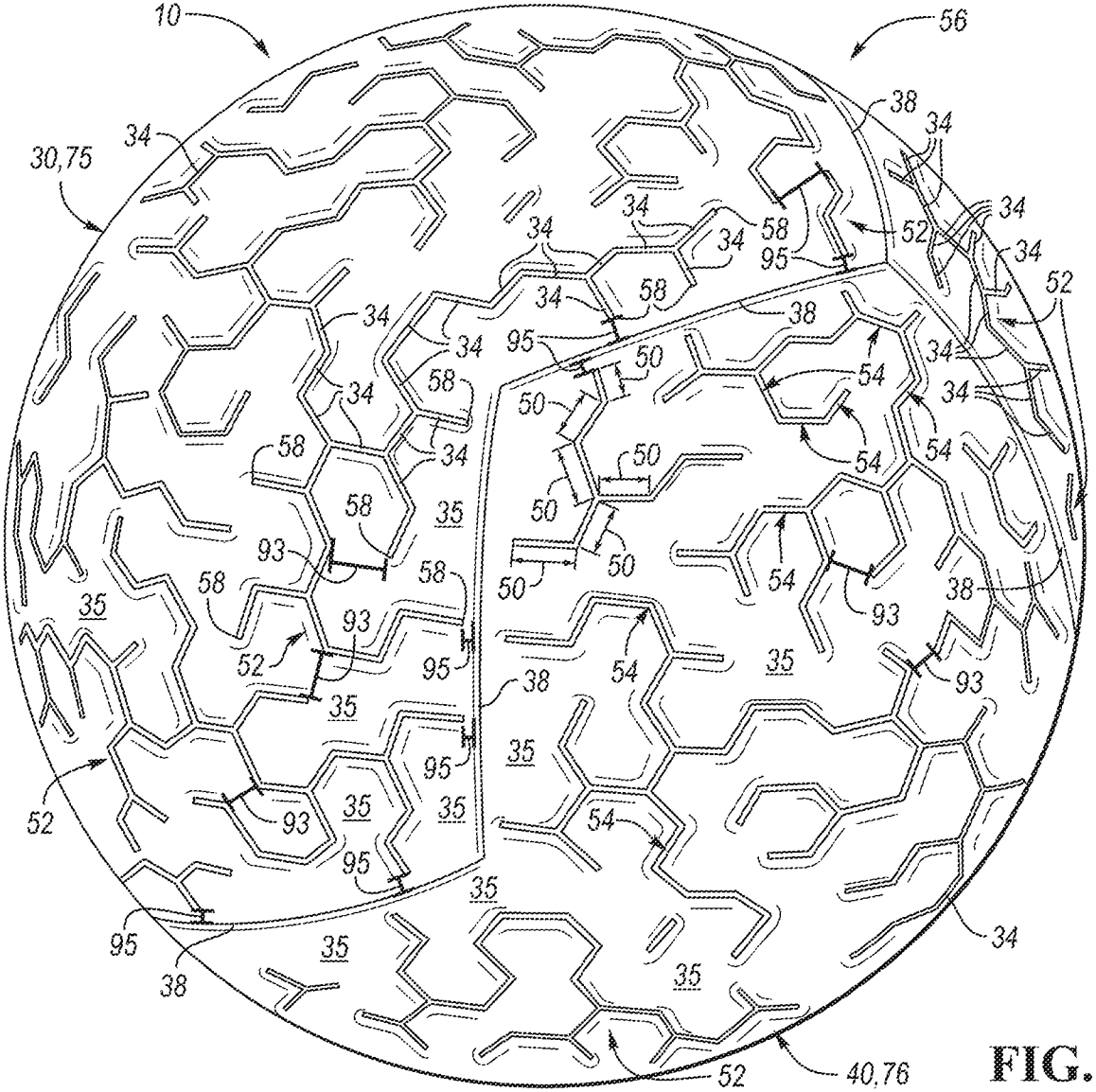
FIG. 3 is a schematic perspective view of a first example configuration of an inflatable sports ball, wherein the cover defines a plurality of channels and a plurality of plateau sections, which cooperate to define a topographical design on the exterior surface of the inflatable sports ball.
Figure 4:
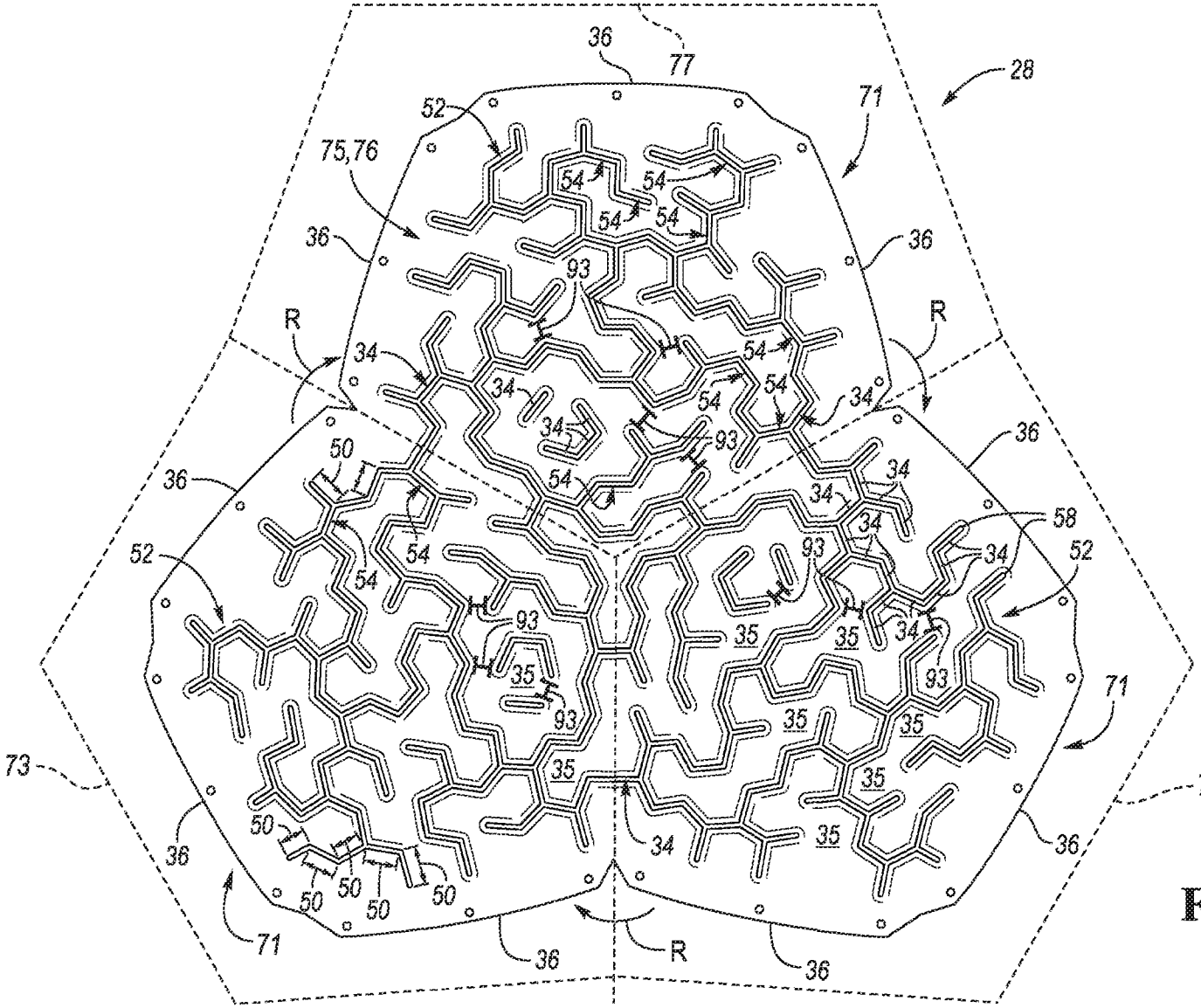
FIG. 4 is a schematic plan view of an example panel of the first example configuration, wherein the example panel has a generally triangular shape that is formed of three pentagons.
Figure 5:
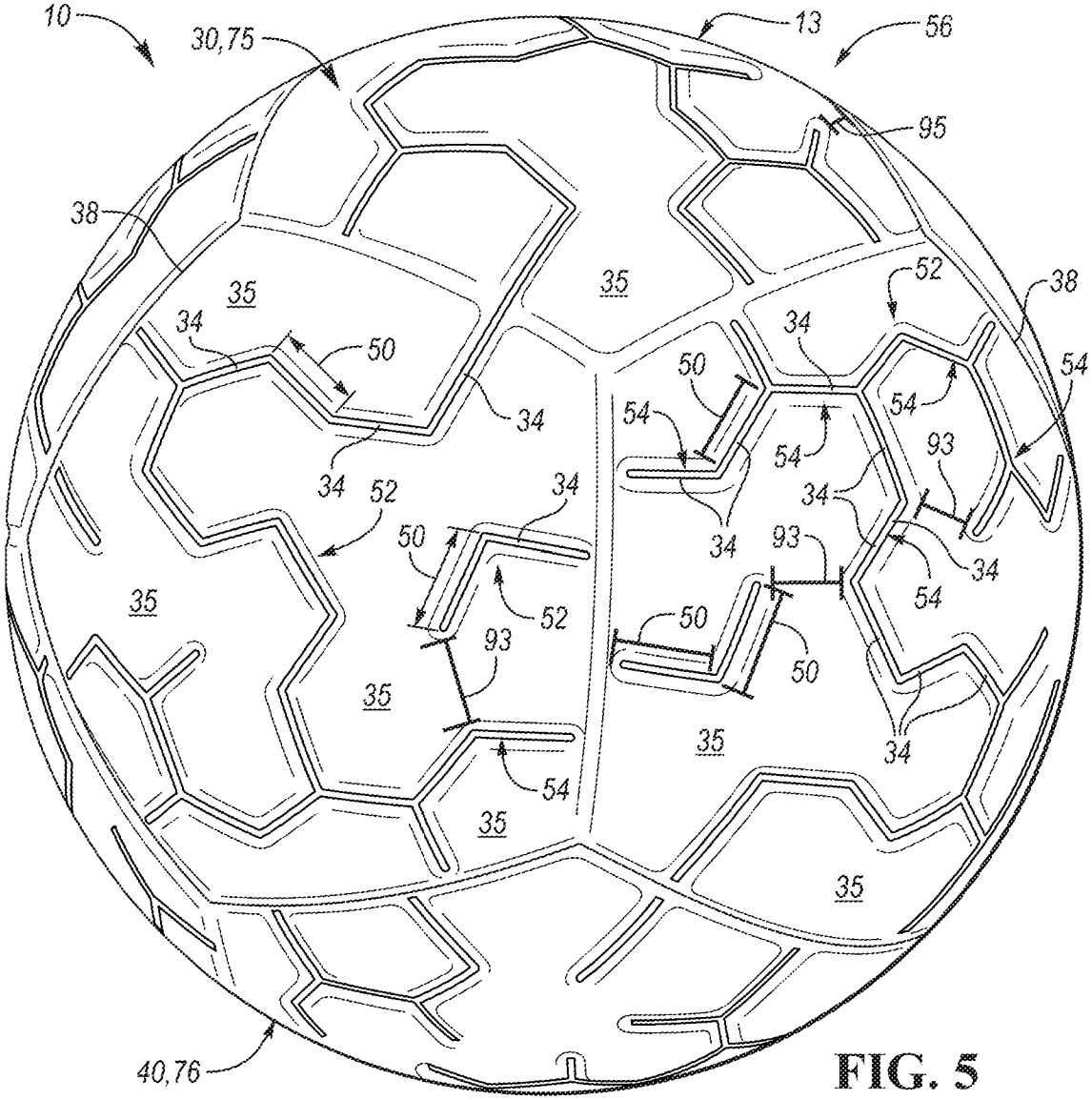
FIG. 5 is a schematic perspective view of a second example inflatable sports ball, wherein the cover defines a plurality of channels and a plurality of plateaus sections, which cooperate to define a topographical design on the exterior surface of the inflatable sports ball.
Figure 6:
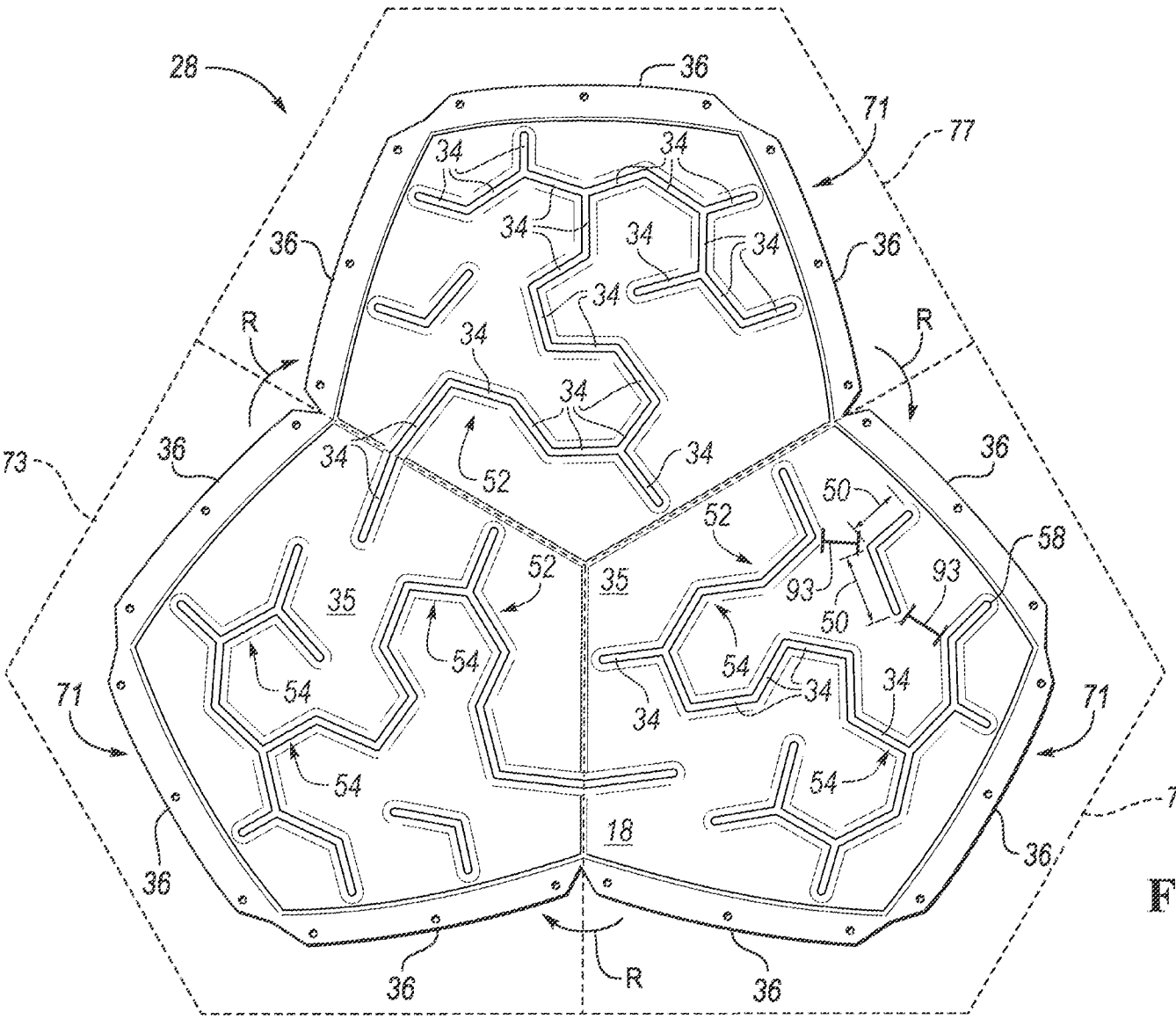
FIG. 6 is a schematic plan view of an example panel of the second example configuration, wherein the example panel has a generally triangular shape that is formed from three pentagons.

The sports ball 10 may further have an aggregate feature length, which is defined as the sum of the first aggregate deboss length (total length of all the peripheral channel segments or seams 38) and the second aggregate deboss length (a sum of all of the interior channel segment lengths 50 of all interior channel segments 34). In example embodiments, the aggregate feature length may be greater than 750 centimeters. By way of example, in FIGS. 3 and 4, the aggregate feature length is from about 1000 centimeters to about 1300 centimeters. In another example, as shown in FIGS. 5 and 6, the aggregate feature length is from about 750 centimeters to about 950 centimeters, wherein the plurality of channels cooperates to cover or define approximately 52% of the exterior surface 13 of the cover 12.

Increased aggregate feature length and increased surface coverage of the exterior surface 13 by the channels 34, 38 creates positive flight characteristics (consistency and length of trajectory) and enhances the aerodynamics of ball 10, i.e., reducing aerodynamic drag on the ball for better accuracy, consistency, and increased velocity. Due to increased aggregate feature length and increased surface coverage of the exterior surface 13 by the channels 34, 38, it is more likely that the boundary layer of air surrounding the sports ball 10 in flight will undergo the transition from laminar flow to turbulent flow at a predetermined point, resulting in enhanced flight characteristics and aerodynamic properties.

However, if aggregate feature length and of the percentage of surface coverage occupied by the channels 34, 38 are increased beyond a critical point, such that the channels 34, 38 do not maintain enough predefined distance 93 therebetween, softness and ball feel characteristics may be diminished. As such, it is desirable to arrange the channel segments 34, 38 on the exterior surface 13 in a topographical arrangement 56 to balance increased aggregate feature length and surface coverage of the exterior surface 13 by the channels 34, 38 to enhance consistency and the aerodynamic properties of the ball 10 without sacrificing softness and ball feel characteristics.

In one example, shown in FIGS. 3-6, non-contiguous interior channel segments 34 may be spaced apart from one another by a first predefined distance 93 that may be greater than 5.0 millimeters. More particularly, the first predefined distance 93 may be from about 7.0 millimeters to about 11.0 millimeters. The interior channel segments 34 may further be spaced apart from peripheral channel segments 38 by a second predefined distance 95. The second predefined distance may be greater than 10 millimeters.

The smaller the predefined distance 93, 95 between two respective channels 34, 38 the harder the ball surface at the respective measurement point. Maintaining a minimum acceptable predefined distance 93, 95 between channel segments 34, 38 allows the ball 10 to maintain desired softness and ball feel characteristics. An example ball 10 having a distance 93, 95 smaller than the predefined distance 93, 95 between two respective non-contiguous channels 34, 38 the harder the ball surface at the respective measurement point.

The plurality of plateau sections 35, the plurality of peripheral channel segments or seams 38, and the plurality of interior channel segments 34 cooperate to define the topographical arrangement 56 across a majority of the exterior surface 13 of the cover 12.

With reference to the example configurations of topographic designs 56 shown in FIGS. 3-6, the exterior surface of the sports ball 10 and the respective panel surface may define a plurality of plateau sections 35. Each of the plurality of interior channel segments 34 may be provided within a central region of one or more of the panels 28, and further be positioned between the plateau sections 35. The interior channel segments 34 further divide the exterior surface 13 of the ball and the respective panel surface into a plurality of open polygonal portions 54. Each interior channel segments 34 may define at least a portion of a side of at least one of the open polygonal portions 54, such that a plateau section 35 is defined between interior channel segments 34 and within an interior of each open polygonal portions 54. In this way, the plateau sections 35 are formed as open polygons. Further, each interior channel segment 34 abuts the adjacent plateau section 35 at a connection edge positioned at the shoulder portion 29 of the respective interior channel segment, and each interior channel segment 34 is linear along the connection edge, such that the connection edge itself is linear, thereby forming a straight edge or straight side of the respective open polygonal portion 54.

The interior channel segments 34 that connect to one another to form the open polygonal portions 54 connect at an oblique angle. Said another way, each interior channel segment 34 that is connected to another interior channel segment 34 is obliquely angled with respect to the other interior channel segment 34. In this way, each interior channel segment 34 may be one of a plurality of interconnected channel segments forming a more extended indentation or debossed feature.

In the designs shown in FIGS. 3-6, connected interior channel segments 34 further form more extended indentation or debossed feature in the form of a linkage 52. Within the linkage 52, the at least one interior channel segment 34 defines a linkage end point 58. The linkage 52 is defined as a continuous network of interior channel segments 34 between a first linkage end point 58 and a second linkage end point 58. In some embodiments, the linkage 52 is defined as a continuous network of interior channel segments 34 that does not close a loop upon itself.

Each open polygonal portion 54 may be contiguous with at least one adjacent open polygonal portion 54. Further each open polygonal portion 54 may be separated from at least one adjacent open polygonal portion 54 via one or more of the plurality of interior channel segments 34. By way example, in FIGS. 3-6, open pentagons and open hexagons are shown. In this way, each of the open polygonal portions 54, if closed, would have a total of five or more sides, i.e., be defined by five or more interior channels 34. As such, in the example configurations of FIGS. 3-6, each open polygonal portion 54 is an open polygon rather than a closed polygon. As such, each open polygonal portion 54 is missing at least one side. In some embodiments, each open polygonal portion 54 is missing at least one side and no more than three sides. More particularly, in some examples, each open polygonal portion 54 is defined by at least three interior channel segments 34 and no more than five interior channel segments 34.

The open polygonal portions 54 may be of varying cell size. As shown, the open polygonal portions 54 of FIGS. 3 and 4 are smaller in cell size than those of FIGS. 5 and 6. However, regardless of cell size, in any predefined panel arrangement 75, 76 the peripheral channel segments 38 and the interior channel segments 34 cooperate to define approximately the same percentage of exterior surface 13 of a respective panel 28. Said another way, each panel 28 may have a substantially similar number of peripheral channel segments 38 and interior channel segments 34, by length and surface area, as each of the other panels 28 of the ball 10, which promotes a balanced design across the exterior surface 13 ball 10. As detailed herein above, the examples shown in FIGS. 3-6 maintain an exterior surface 13, wherein from about 40% to about 65% of the exterior surface 13 is defined by the interior channel segments 34. More particularly, the example shown in FIGS. 3-6, maintain an exterior surface 13, wherein from about 50% to about 55% of the exterior surface 13 is defined by the interior channel segments 34.

Further, in the example configuration of FIGS. 3-6, the orientation of the peripheral channel segments 38 and the interior channel segments 34 promotes a balanced and substantially symmetrical design across the exterior surface 13 ball 10. A balanced topographical design 56, as shown by example in FIGS. 3-6, avoids uneven lift of the ball 10 and improves consistency of the ball 10 when kicked in any orientation. As such, a balanced topographical design 56, such as those shown in FIGS. 3-6, allows the ball 10 to fly or travel the substantially the same regardless of the orientation of the ball 10 when kicked. Ball 10 consistency is one property that is often commented on by players. The most consistent balls are the ones with the optimum combination of amplitude and frequency of the varying force coefficients relative to the amount of spin. As such, the tailoring of the topographical design 56 on the ball 10 may allow for optimization of consistency and improved aerodynamics.

Further referring to FIGS. 3-6, the topographical design 56 may be composed of predefined panel arrangements 75, 76. Each predefined panel arrangement 75, 76 may be comprised of a plurality of sub-panel arrangements 71.

In an example twelve panel ball 10, the topographical design 56 may be comprised of six pairs of predefined panel arrangements 75, 76. In this example, corresponding panel arrangements 75, 76 would be disposed opposite one another on the ball 10, when the respective panels 28 are coupled at the peripheral seams 38. In an example four panel ball 10, wherein each panel 28 is essentially comprised of three conventional pentagon-shaped panels of a conventional twelve panel ball 10, each of the four panels 28 contains a plurality of sub-panel arrangements 71 positioned in a specified orientation on three respective panel sections 73, 77, 79.

More particularly, referring to FIGS. 4 and 6, the ball 10 is composed of four panels 28. The sub-panel arrangement 71 is disposed in a first orientation on a first panel section 73. The sub-panel arrangement 71 is then rotated approximately 120 degrees in a specified rotational direction R from the first orientation to a second orientation and disposed on the second panel section 77 in the second orientation. The sub-panel arrangement 71 may then be rotated again approximately an additional 120 degrees in a specified rotational direction R from the second orientation to a third orientation, and disposed upon a third panel section 79 in the third orientation.

In the four-panel ball 10 example of FIGS. 4 and 6, panels 28 may be coupled, such that the orientation of the peripheral seams 38 and interior channel segments 34 promotes a balanced design across the exterior surface 13 of the ball 10. Said another way, the design is both balanced and symmetrical in that each panel defines substantially the same number of plateau sections 35, peripheral channel segments 38, and interior channel segments 34 as the other panels 28. Moreover, each peripheral channel segment 38 present on one portion of the ball 10 has a corresponding opposite peripheral channel segment 38 disposed opposite thereof on the exterior surface 13 of the ball 10. Likewise, each interior channel segment 34 present on one portion of the ball 10 has a corresponding opposite interior channel segment 34 disposed opposite thereof of the ball 10.

Figure 3A:
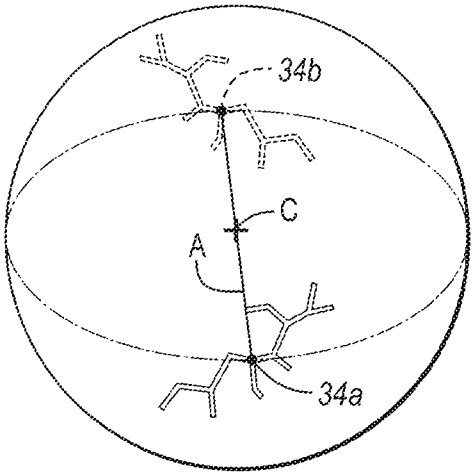
FIG. 3A is a schematic perspective view of the first example sports ball of FIG. 3, wherein the sports ball has a ball center and a central axis.
Figure 5A:
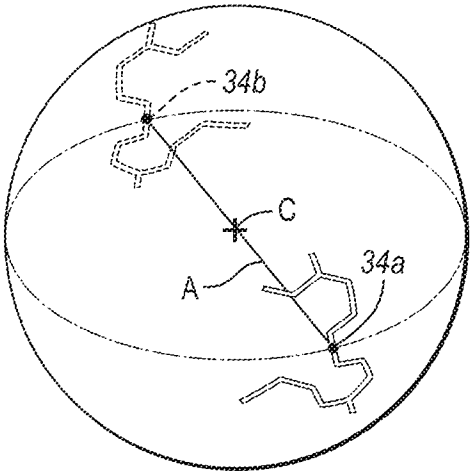
FIG. 5A is a schematic perspective view of the second example sports ball of FIG. 5, wherein the sports ball has a ball center and a central axis.

More particularly, in this way, the inflatable sports ball 10 has an interior center C and the interior center C is positioned on a central axis A, as shown in FIGS. 3A and 5A. As shown in FIGS. 3A and 5A, the plurality of interior channel segments 34 may further comprise a first interior channel segment 34*a* and a second interior channel segment 34*b*. The first interior channel segment 34*a* is at least partially disposed on the central axis A and the second interior channel segment 34*b* is likewise at least partially disposed on the central axis A, such that the first interior channel segment 34*a* is positioned directly opposite the second interior channel segment 34*b* upon the exterior surface 13 of the ball 10. The first interior channel segment 34*a* may be of a predefined shape and the second interior channel segment 34*b* may be of the same predefined shape, such that the second interior channel segment 34*b* is substantially similar to or even identical to the first interior channel segment 34*a*.

The detailed description and the drawings or figures are supportive and descriptive of the present teachings, but the scope of the present teachings is defined solely by the claims. While some of the best modes and other embodiments for carrying out the present teachings have been described in detail, various alternative designs and embodiments exist for practicing the present teachings defined in the appended claims.

The invention claimed is:

1. An inflatable sports ball comprising:

an interior bladder capable of being inflated to a predetermined internal pressure, wherein the inflatable sports ball takes on a substantially spherical shape when the interior bladder is inflated to the predetermined internal pressure;

a cover disposed about the interior bladder, the cover comprising a plurality of adjoining panels and defining: an exterior surface;

a plurality of channels extending radially inward from the exterior surface, the plurality of channels including:

a plurality of peripheral channel segments, each defining a peripheral seam between adjoining ones of the plurality of adjoining panels;

a plurality of interior channel segments each provided within a central region of one or more of the plurality of panels, wherein the plurality of interior channel segments divides the exterior surface into a plurality of open polygonal portions having at least five sides, such that the plurality of interior channel segments cooperate to define the topographical arrangement of open polygonal portions across a majority of the exterior surface of the cover; and wherein each interior channel segment defines only one side of at least one of the open polygonal portions, and wherein each open polygonal portion is defined by at least two interior channel segments, and wherein each open polygon is missing at least one side.

2. The inflatable sports ball of claim 1 wherein:

each of the plurality of channel segments has a first end and a second end;

at least one interior channel segment defines a first linkage end point at one of its first end or its second end;

the plurality of interior channel segments forms a linkage, wherein the linkage is defined as a continuous network of connected interior channel segments between the first linkage end point and a second linkage end point, wherein the first linkage end point is spaced apart from the second linkage end point; and wherein each of the interior channel segments within the linkage is connected to another interior channel segment within the linkage at at least one of the first end or the second end and is obliquely angled with respect to the other interior channel segment.

3. The inflatable sports ball of claim 2 wherein:

the exterior surface defines a plateau section within an interior of each open polygonal portion between the interior channel segments;

each interior channel segment abuts the plateau section at a connection edge; and each interior channel segment is linear along the connection edge between the first end and the second end.

4. The inflatable sports ball of claim 3 wherein each open polygonal portion is contiguous with at least one adjacent open polygonal portion, and wherein each open polygonal portion is separated from at least one adjacent open polygonal portion via one or more of the interior channel segments.

5. The inflatable sports ball of claim 4 wherein each open polygon is missing no more than three sides.

6. The inflatable sports ball of claim 5 wherein:

each peripheral seam has a seam length and the plurality of peripheral channel segments has a first aggregate deboss length;

the first aggregate deboss length is defined as a sum of all of the seam lengths; and the first aggregate deboss length is from about 135 centimeters to about 150 centimeters.

7. The inflatable sports ball of claim 6 wherein the first aggregate deboss length is about 144 centimeters.

8. The inflatable sports ball of claim 6 wherein:

each interior channel segment has an interior channel segment length;

the plurality of interior channel segments has a second aggregate deboss length;

the second aggregate deboss length is defined as a sum of all of the interior channel segment lengths; and the second aggregate deboss length is greater than 600 centimeters.

9. The inflatable sports ball of claim 8 wherein the second aggregate deboss length is from about 600 centimeters to about 650 centimeters.

10. The inflatable sports ball of claim 8 wherein:

the plurality of channels has an aggregate feature length, such that the aggregate feature length is defined as a sum of the first aggregate deboss length and the second aggregate deboss length; and the aggregate feature length is greater than 750 centimeters.

11. The inflatable sports ball of claim 10 wherein the aggregate feature length is from about 770 centimeters to about 780 centimeters and the plurality of channels cooperates to define about 52% of the exterior surface of the cover.

12. The inflatable sports ball of claim 11 wherein:

each interior channel segment has an interior channel segment width and an interior channel segment terminus that is radially-spaced apart from the exterior surface by an interior channel segment depth;

the interior channel segment depth is greater than 0.8 millimeters; and the interior channel segment width is from about from about 7 millimeters to about 12 millimeters.

13. An inflatable sports ball comprising:

an interior bladder capable of being inflated to a predetermined internal pressure, wherein the inflatable sports ball takes on a substantially spherical shape when the interior bladder is inflated to the predetermined internal pressure;

a cover disposed about the interior bladder, the cover comprising a plurality of adjoining panels and defining:

an exterior surface;

a plurality of channels extending radially inward from the exterior surface, the plurality of channels including:

a plurality of peripheral channel segments, each defining a peripheral seam between adjoining ones of the plurality of adjoining panels; and a plurality of interior channel segments having a first end and a second end, each interior channel segment provided within a central region of one or more of the plurality of adjoining panels, wherein the plurality of interior channel segments divides the exterior surface into a plurality of open polygonal portions having at least five sides, wherein each open polygon is missing at least one side and no more than three sides, such that each interior channel segment defines only one side of at least one of the open polygonal portions and each open polygonal portion is defined by at least two interior channel segments, and wherein the plurality of interior channel segments cooperate to define the topographical arrangement of open polygonal portions across a majority of the exterior surface of the cover;

wherein the exterior surface defines a plateau section within an interior of each open polygonal portion between the interior channel segments, such that the respective interior channel segment and the plateau section abut at a connection edge, and wherein the interior channel segment is linear along the connection edge between the first end and the second end;

wherein the plateau sections, the plurality of peripheral channel segments, and the plurality of interior channel segments cooperate to define a topographical arrangement upon the exterior surface of the cover;

wherein each peripheral channel segment has a seam length and the plurality of peripheral channel segments has a first aggregate deboss length defined as the sum of all the seam lengths, each interior channel segment has an interior channel segment length and the plurality of interior channel segments has a second aggregate deboss length defined as the sum of all interior channel segment lengths, and wherein within the topographical arrangement the plurality of channels has an aggregate feature length being defined as a sum of the first aggregate deboss length and the second aggregate deboss length;

wherein the first aggregate deboss length is from about 135 centimeters to about 150 centimeters, the second aggregate deboss length is from about 600 centimeters to about 650 centimeters, and the aggregate feature length is greater than 750 centimeters.

14. The inflatable sports ball of claim 13 wherein the plurality of adjoining panels includes at least a first panel and a second panel, and wherein the first panel defines a substantially similar number of plateaus, peripheral channel segments, and interior channel segments as the second panel.

15. The inflatable sports ball of claim 14 wherein the plurality of interior channel segments and plurality of peripheral channel segments are arranged in a predefined panel arrangement on each of the respective panels, and wherein each predefined panel arrangement is comprised of a plurality of sub-panel arrangements.

16. The inflatable sports ball of claim 15 wherein:

the inflatable sports ball has an interior center, the interior center being positioned on a central axis;

the plurality of interior channel segments comprises a first interior channel segment of a predefined shape and a second interior channel segment of the predefined shape, wherein the predefined shape of the second interior channel segment is substantially similar to the predefined shape of the first interior channel segment; and the first interior channel segment is at least partially disposed on the central axis and a second interior channel segment is at least partially disposed on the central axis, such that the first interior channel segment is positioned directly opposite the second interior channel segment upon the exterior surface of the ball.

17. The inflatable sports ball of claim 16 wherein:

each interior channel segment is connected to another interior channel segment at at least one of the first end or the second end, and is obliquely angled with respect to the other interior channel segment; and each open polygonal portion is contiguous with at least one adjacent open polygonal portion, such that each open polygonal portion is separated from at least one adjacent open polygonal portion via one or more of the interior channel segments.

18. The inflatable sports ball of claim 13 wherein the aggregate feature length is from about 770 centimeters to about 780 centimeters and the plurality of channels cooperates to define about 52% of the exterior surface of the cover.

* * * * *